US005443589A

United States Patent [19]

Brandon

[11] Patent Number: 5,443,589

[45] Date of Patent: Aug. 22, 1995

[54] STEAM TURBINE BELL SEALS

[76] Inventor: Ronald E. Brandon, 627 Jubilee St., Melbourne, Fla. 32940

[21] Appl. No.: 175,522

[22] Filed: Dec. 30, 1993

[51] Int. Cl.[6] ..... F01D 25/26

[52] U.S. Cl. ..... 415/134; 415/136; 277/236

[58] Field of Search ..... 415/134, 136, 138; 277/116.8, 236

[56] References Cited

U.S. PATENT DOCUMENTS

| | | | |
|---|---|---|---|
| 2,112,738 | 3/1929 | Doran | 415/108 |
| 2,505,217 | 4/1950 | Smith et al. | 415/136 |
| 2,527,445 | 10/1950 | Pentheny | 415/138 |
| 2,527,446 | 10/1950 | Jenks, Jr. et al. | 415/139 |
| 2,800,299 | 7/1957 | Sheppard et al. | 415/136 |
| 3,907,308 | 9/1975 | Stock | 277/72 R |
| 4,032,253 | 6/1977 | Ryncosky et al. | 415/136 |
| 4,697,983 | 10/1987 | Yamaguchi | 415/134 |
| 4,772,178 | 9/1988 | Miller | 415/177 |
| 4,802,679 | 2/1989 | Chen et al. | 277/12 |
| 4,812,105 | 3/1989 | Heymann | 415/134 |
| 5,037,270 | 8/1991 | Bangel et al. | 415/134 |
| 5,058,906 | 10/1991 | Adamek et al. | 277/236 |
| 5,076,594 | 12/1991 | Baugh | 277/236 |
| 5,141,393 | 8/1992 | Marra | 415/138 |
| 5,282,652 | 2/1994 | Werner | 277/116.8 |

FOREIGN PATENT DOCUMENTS

| | | | |
|---|---|---|---|
| 0147194 | 10/1962 | U.S.S.R. | 415/138 |

*Primary Examiner*—Edward K. Look
*Assistant Examiner*—Mark Sgantzos
*Attorney, Agent, or Firm*—Ross, Ross & Flavin

[57] ABSTRACT

An improved bell seal arrangement for steam turbines is provided that allows the bell to expand thermally without damage to the opposing seal surface of the inner shell by the addition of components that allow yielding of the seal surface without causing permanent distortion or surface damage.

4 Claims, 8 Drawing Sheets

STEAM TURBINE BELL SEALS

BACKGROUND OF THE INVENTION

1. Field of the Invention

Steam turbines whose design includes double shell construction require devices that allow the two shells to expand and contract differentially, without allowing significant leakage out of the steam pipes that carry steam from the outer shell to the inner shell.

2. Description of the Prior Art

A common system employed by turbine manufacturers is called a bell seal. The bell slides into a tube held by the inner shell providing a minimum radial clearance with the tube, yet allowing vertical differential motion of the inner and outer shells. The bell is also secured to a tube held by the outer shell in such a way that it can slide, permitting differential motion in either the lateral or axial directions relative to the shaft, yet maintaining a small clearance that keeps leakage to a minimum.

This bell seal system is commonly found, after service, to have a clearance between the bell and the inner shell tube of about 0.010 inches. This allows significant leakage and loss of turbine output. Replacement of the bell seal is usually ineffective, with the clearance and leakage recurring.

The major problem is that the bell seal itself is of very powerful construction and when it becomes hot during starting procedures, while the inner shell tube is still relatively cool, its thermal growth can stretch and crush the opposing surfaces on the inner shell tube. Even during steady state operation, the bell may be hotter than the inner shell tube. The described problem is especially apparent on larger turbines where the bell diameter is greater.

An improvement to the bell seal system that prevents crushing the mating surfaces or stretching them beyond the elastic limit would provide significant improvement in turbine efficiency.

SUMMARY OF THE INVENTION

It is the object of the present invention to provide a bell seal system that achieves small leakage clearance in spite of unavoidable thermal gradients.

The invention is practiced by providing opposing seal surfaces and materials that permit differential expansion caused by thermal gradients without causing either surface damage or permanent stretching of the walls and sealing components.

This is accomplished by modifying the bell itself to provide a "deflection" slot, or by interposing an additional component between the inner shell and bell, the component opposing the bell seal. This component is thin enough and of satisfactory material to be stretched by the bell seal during a start-up without exceeding its elastic limit, thus maintaining a small clearance at all operating conditions.

DESCRIPTION OF THE PREFERRED EMBODIMENTS

Figure 1:
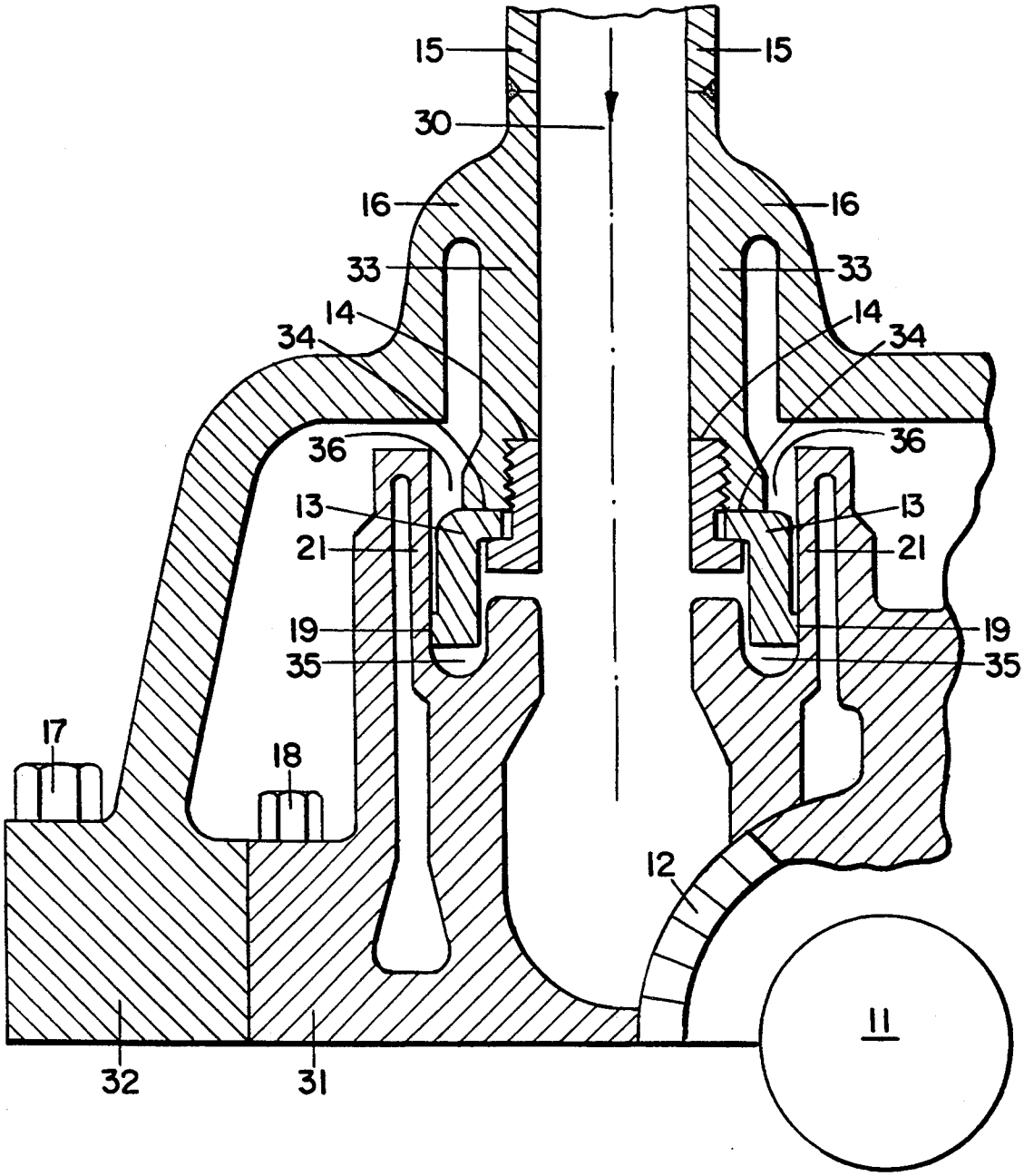
FIG. 1. (PRIOR ART)
FIG. 1 is a fragmentary view of a selected portion of a prior art turbine, partly in section, showing a typical bell seal as currently used in many steam turbines.

Referring to FIG. 1, some of the key elements of the high pressure inlets to a prior art turbine are shown, illustrating current practice. A shaft 11 carries buckets or rotating blades (not shown) that pass circumferentially downstream of nozzles 12. Steam is admitted to the nozzles through a passageway 30 by means of an external pipe 15, connected to an outer shell 16 and to an inner shell 21. Passageway 30 continues to the entrance of the nozzles 12.

The drawing shows only one inlet. In actual practice, a full circle of inlets would include six to eight such inlet passages, each providing steam to a separate section of nozzles.

Inner shell 21 includes nozzles 12, flow passages 30, flange bolts 18, a flange 31 and a cylindrical surface 19 to provide a small clearance seal with a bell seal 13 that is held in an extension of outer shell 16. There are, of course, many other components in the inner shell, but they are not significant to this invention.

Outer shell 16 includes cylindrical tubes or pipes 33 that conduct steam from the outer shell to the inner shell through passage 30. Tubes or pipes 33 also locate bell seal 13 which prevents or minimizes steam leakage from passage 30 into the space between the inner and outer shells. The bell seal is free to move sideways by sliding of a contact surface 34 to facilitate differential motion of the inner and outer shells. The bell seal can slide vertically along seal surfaces 19 to also accommodate differential expansion of the inner and outer shells.

A nut 14 holds the bell in proper vertical alignment with the outer shell inlet pipes 33 allowing any necessary side motion of contact surface 34.

The outer shell also includes flanges 32 and bolts 17, and is connected to the main steam pipes 15. Other components are also present, but not necessary for this discussion.

A high pressure zone in the area below bell seal 13 is identified by 35; and a low pressure zone in the area above bell seal 13 is identified by 36.

Figure 2:
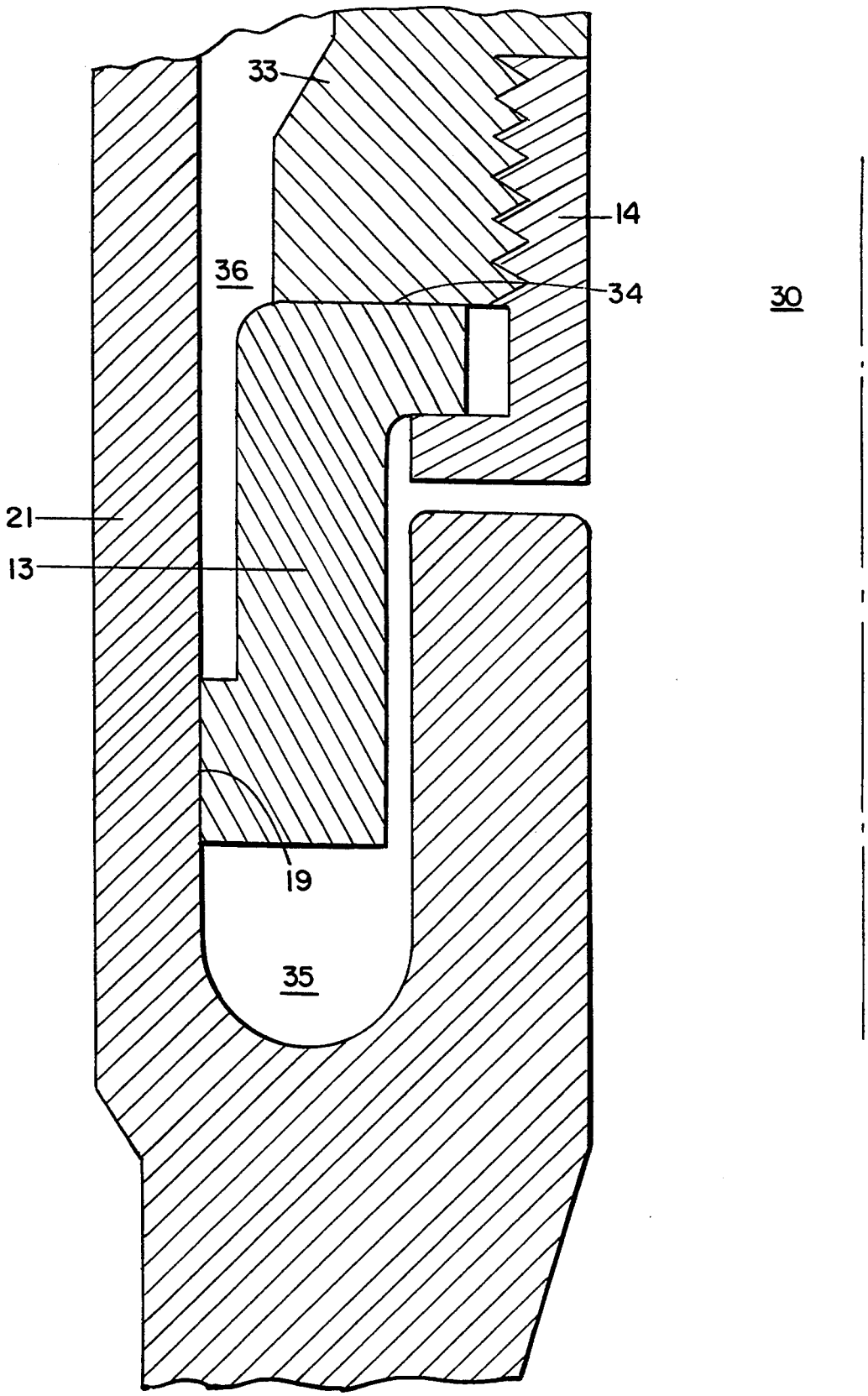
FIG. 2. (PRIOR ART)
FIG. 2 is an enlarged, fragmentary view of a selected portion of the prior art turbine and bell seal of FIG. 1.

FIG. 2 is an enlarged, fragmentary, cross sectional view of a portion of the prior art bell seal of FIG. 1 and the adjacent locating and seal surfaces. Bell 13 is secured to outer shell tube 33 by nut 14. The nut is tightened so as to position the bell vertically yet not prevent sideways motion at surface 34. The bell makes small clearance contact with inner shell 21 at surface 19.

Figure 3:
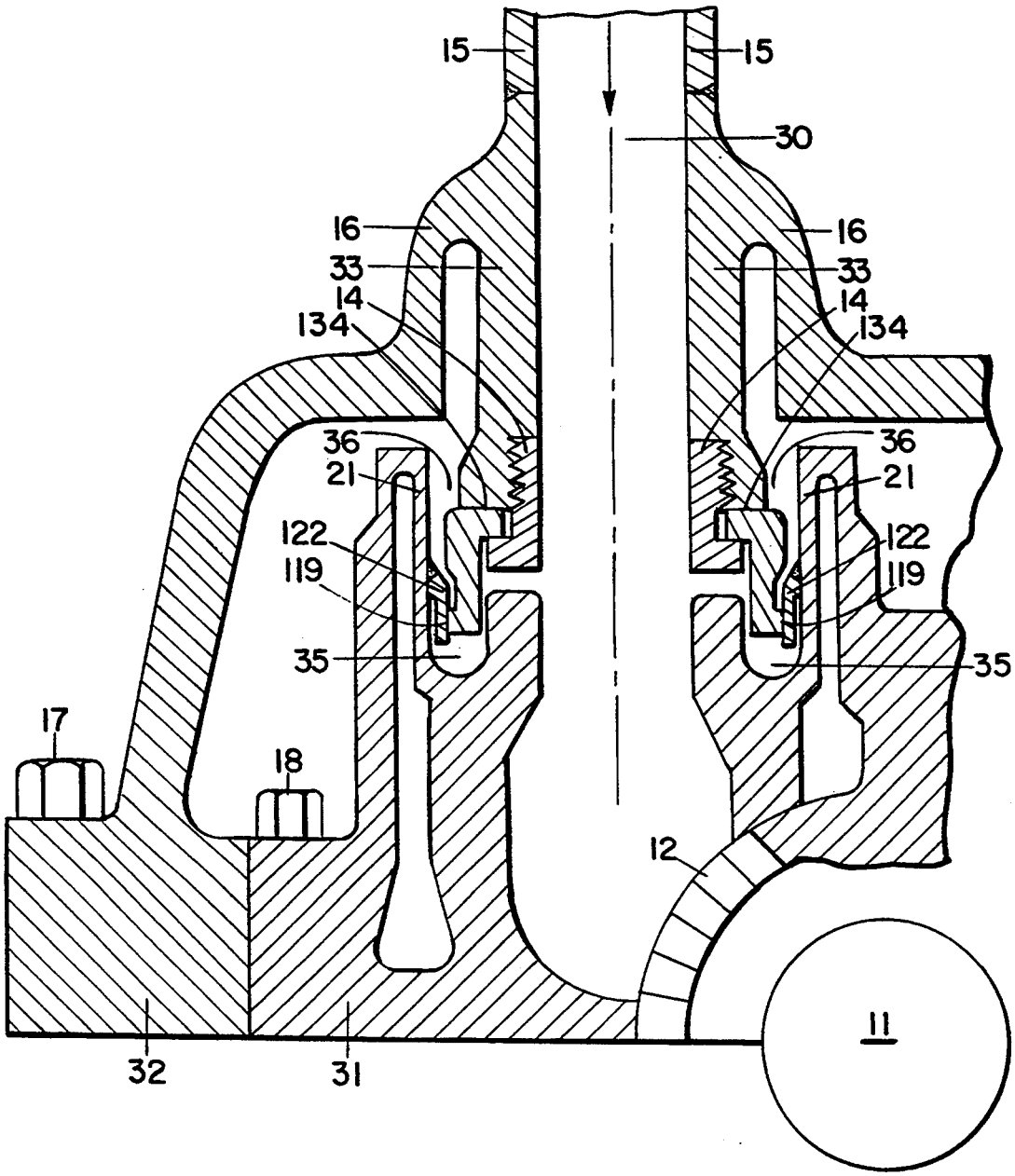
FIG. 3 is a fragmentary view of a selected portion of a turbine, partly in section, showing the seal surfaces for an improved bell seal embodying one form of the invention.

FIG. 3 is a fragmentary cross sectional view of the turbine of FIG. 1, with the bell seal area incorporating improvements in accordance with a preferred form of the invention.

In the turbine of FIG. 3, shaft 11 carries buckets or rotating blades (not shown) that pass circumferentially downstream of nozzles 12. Steam is admitted to the nozzles through passageway 30 by means of external pipe 15, connected to outer shell 16 and to inner shell 21. Passageway 30 continues to the entrance of the nozzles 12.

The drawing shows only one inlet. In actual practice, a full circle of inlets would include six to eight such inlet passages, each providing steam to a separate section of nozzles.

Inner shell 21 includes nozzles 12, flow passages 30, flange bolts 18, flange 31 and a cylindrical surface 119 to provide a small clearance seal with a bell seal 113 that is held in an extension of outer shell 16.

Outer shell 16 includes cylindrical tubes or pipes 33 that conduct steam from the outer shell to the inner shell through passage 30. Tubes or pipes 33 also locate bell seal 113 which prevents or minimizes steam leakage from passage 30 into the space between the inner and outer shells. The bell seal is free to move sideways by sliding of a contact surface 134 to facilitate differential motion of the inner and outer shells. Bell seal 113 can slide vertically along seal surface 119 to also accommodate differential expansion of the inner and outer shells.

A nut 14 holds the bell in proper vertical alignment with the outer shell inlet pipes 33 allowing any necessary side motion of contact surface 134.

The outer shell also includes flanges 32 and bolts 17, and is connected to the main steam pipes 15. Other components are also present, but not necessary for this discussion.

As with the turbine of FIG. 1, the high pressure zone in the area below bell seal 13 is identified by 35; and the low pressure zone in the area above bell seal 13 is identified by 36.

Figure 3A:
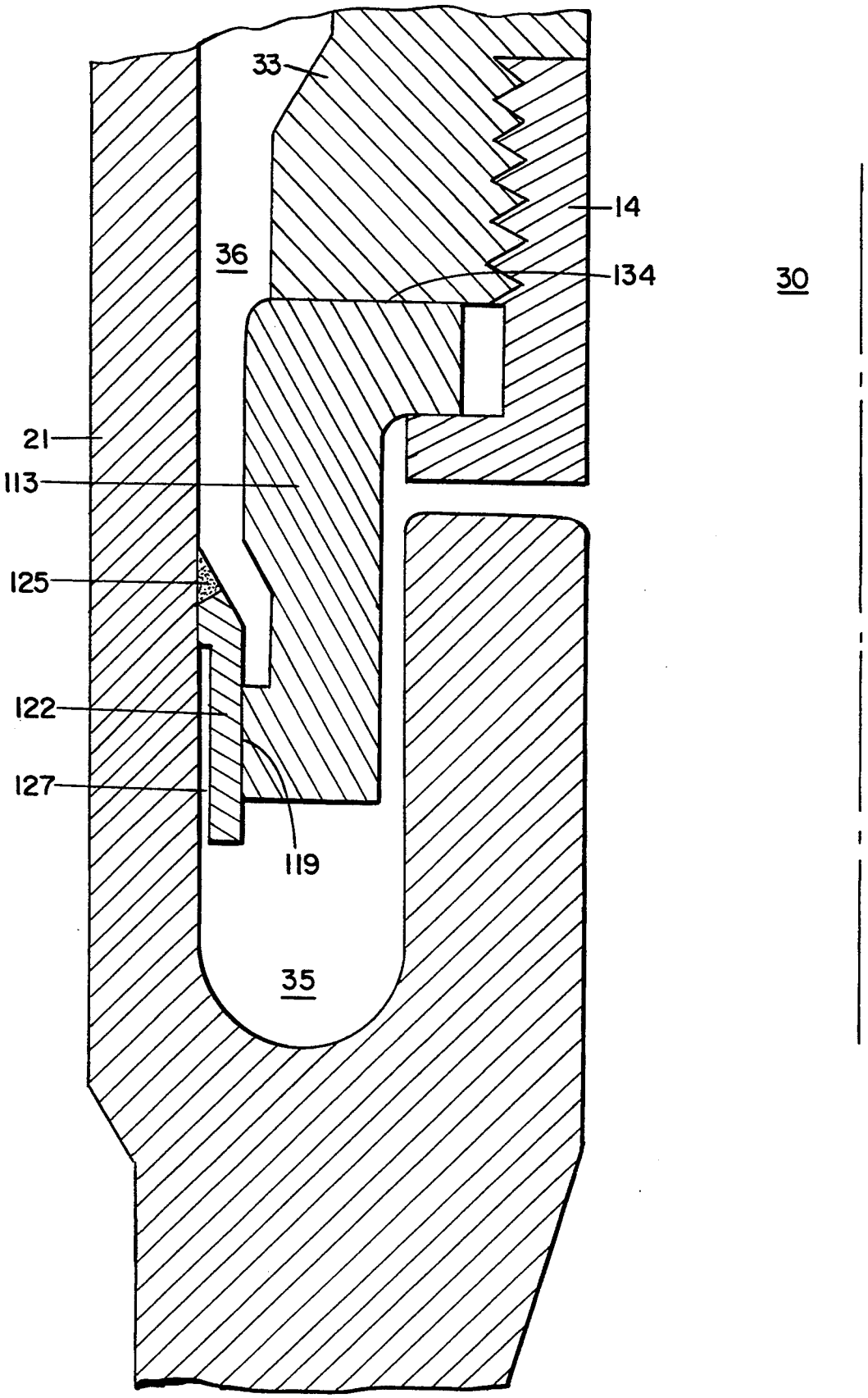
FIG. 3A is an enlarged, fragmentary view of a selected portion of the turbine and bell seal of FIG. 3.

As best seen in FIG. 3A, which is an enlarged, fragmentary cross sectional view of the bell seal area of FIG. 3 with improvements in accordance with the invention, bell 113 has been machined to provide radial space for a flexing ring seal 122. The flexing ring seal is secured to inner shell 21 by a weld 125 and has a clearance gap 127 with inner shell 21 permitting radial motion when the bell is enlarged relative to the inner shell due to the hotter condition of the bell. Radial seal surface 119 between flexing seal 122 and bell 113 minimizes leakage past the bell.

Figure 4:
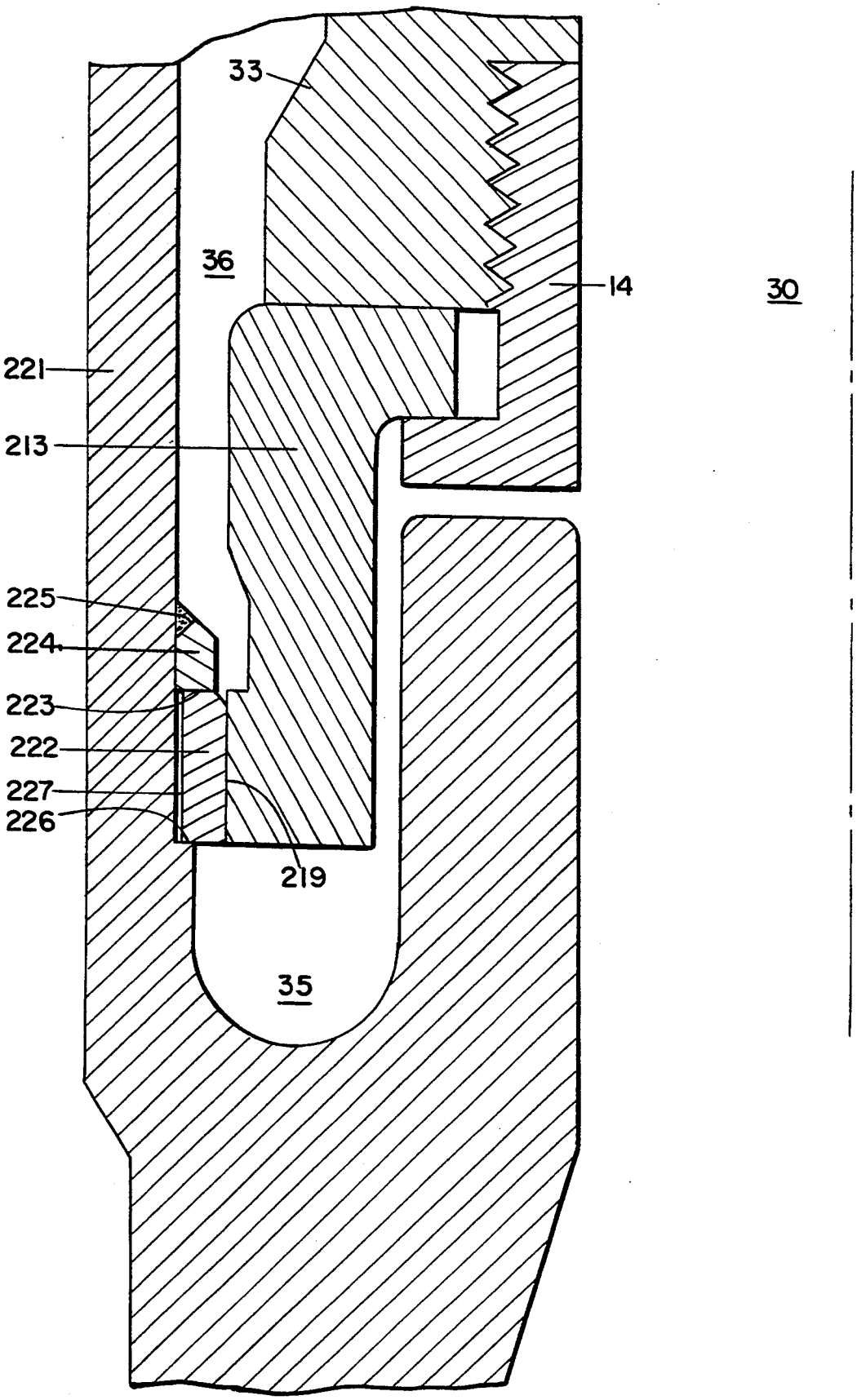
FIG. 4 is an enlarged, fragmentary cross sectional view showing the seal surfaces for a first alternative improved bell seal embodying the invention.

FIG. 4 is an enlarged fragmentary cross sectional view of the bell seal area with a first alternative improvement in accordance with the invention. A bell 213 is machined to provide radial space for a two-part flexing ring seal 222 comprising first and second parts 222A and 222B respectively. Flexing ring seal 222 can be stretched when the bell is enlarged. Flexing ring seal first part 222A is vertically secured by a combination of a shoulder 226 on an inner shell 221 and flexing ring second part 222B secured to inner shell 221 by a weld 225. A vertical seal surface 223 between flexing ring first part 222A and flexing ring second part 222B and a radial seal surface 219 between flexing ring first part 222A and bell 213 minimize leakage past the bell seal. A clearance gap 227 between flexing ring first part 222A and inner shell 221 permits radial motion when the bell is enlarged relative to the inner shell due to its hotter condition.

Bell 213 is secured to outer shell tube 33 by nut 14.

Figure 5:
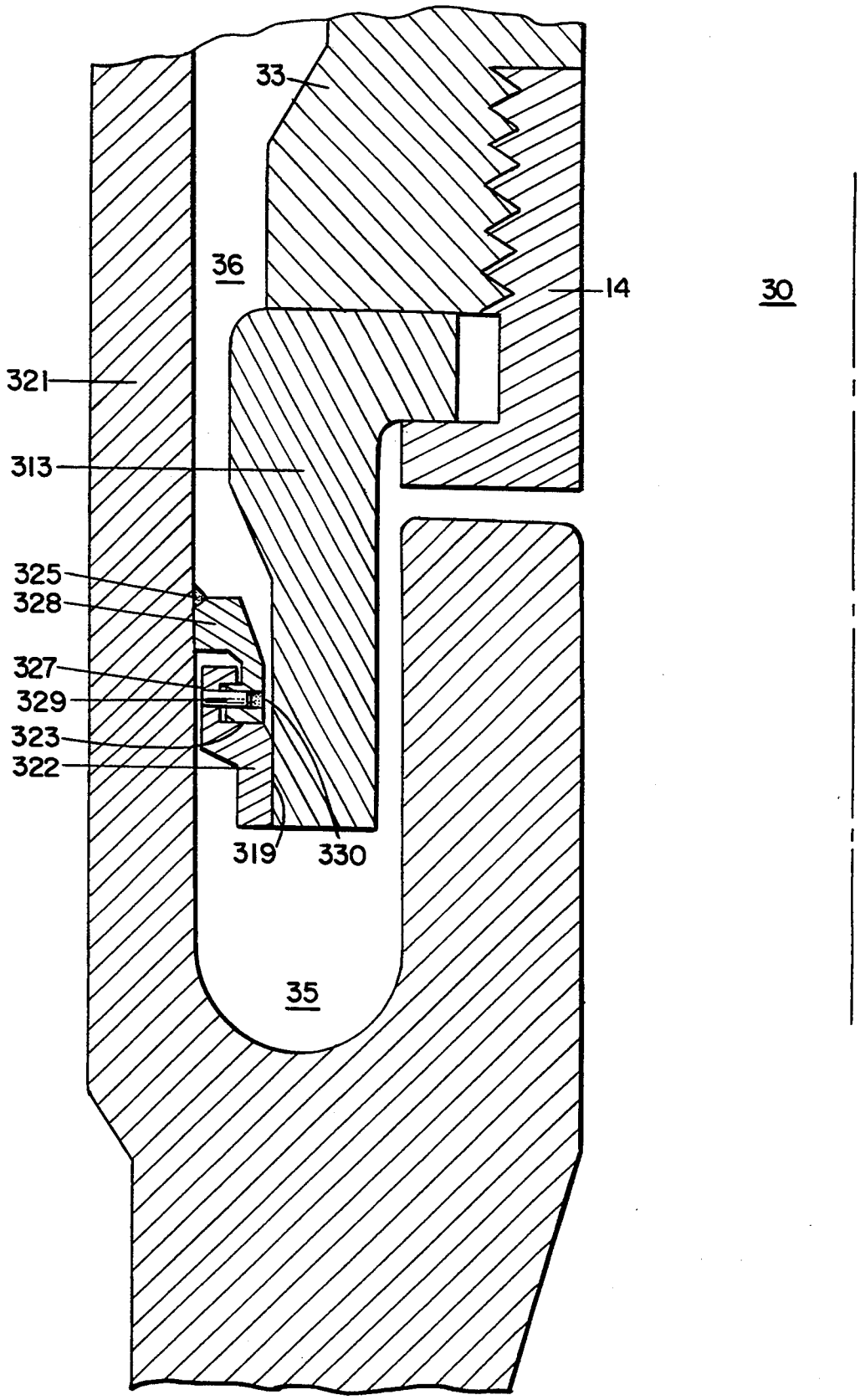
FIG. 5 is an enlarged, fragmentary cross sectional view showing the seal surfaces of a second alternative improved bell seal embodying the invention.

FIG. 5 is an enlarged, fragmentary cross sectional view of the bell seal area with a second alternative improvement in accordance with the invention. A bell 313 is machined to provide radial space for a two-part flexing ring seal 322 comprising first and second parts 322A and 322B respectively, with second part 322B acting as a locating ring for first part 322A. The two parts are provided with a breech lock fit that allows them to be engaged. The lock is secured by a dowel pin 329 and the second part 322B is vertically secured to an inner shell 321 by a weld 325. Dowel pin 329 must be secured after assembly by such as a weld 330.

A seal surface 323 between flexing ring first part 322A and second part 322B, and a seal surface 319 between flexing ring first part 322A and bell 313 minimize leakage around the bell.

A clearance gap 327 between flexing ring first part 322A and inner shell 321 permits radial motion when the bell is enlarged relative to the inner shell due to its hotter condition.

Bell 313 is secured to outer shell tube 33 by nut 14.

Figure 6:
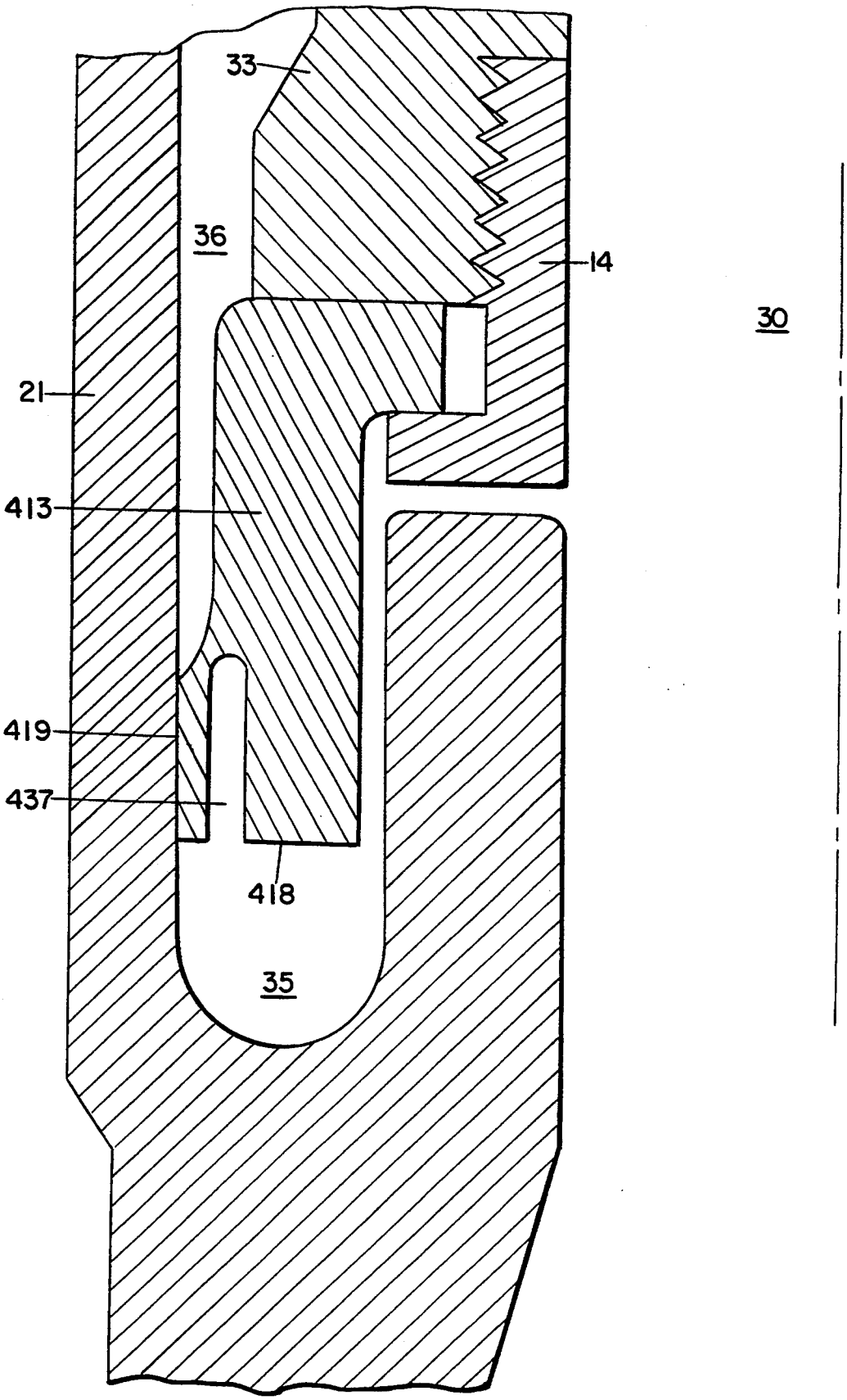
FIG. 6 is an enlarged, fragmentary cross sectional view showing the seal surfaces for a third alternative improved bell seal embodying the invention.

FIG. 6 is an enlarged, fragmentary cross sectional view of the bell seal area and showing a third alternative improvement in accordance with the invention.

All parts are the same as those shown in FIGS. 1 and 2 except for the addition of a vertically disposed slot 437 in a bell seal 413.

Slot 437 extends inwardly into bell seal 413 from a lower face 418 of the bell and is disposed inwardly of and in spaced parallelism to an outer peripheral seal surface 419 of the bell.

Slot 437 allows seal surface 419 of the bell to yield when thermal growth of the bell causes it to be larger than inner shell 21. The stress caused by the worst expected yielding should not be high enough to result in creep or permanent distortion of the bell.

Figure 7:
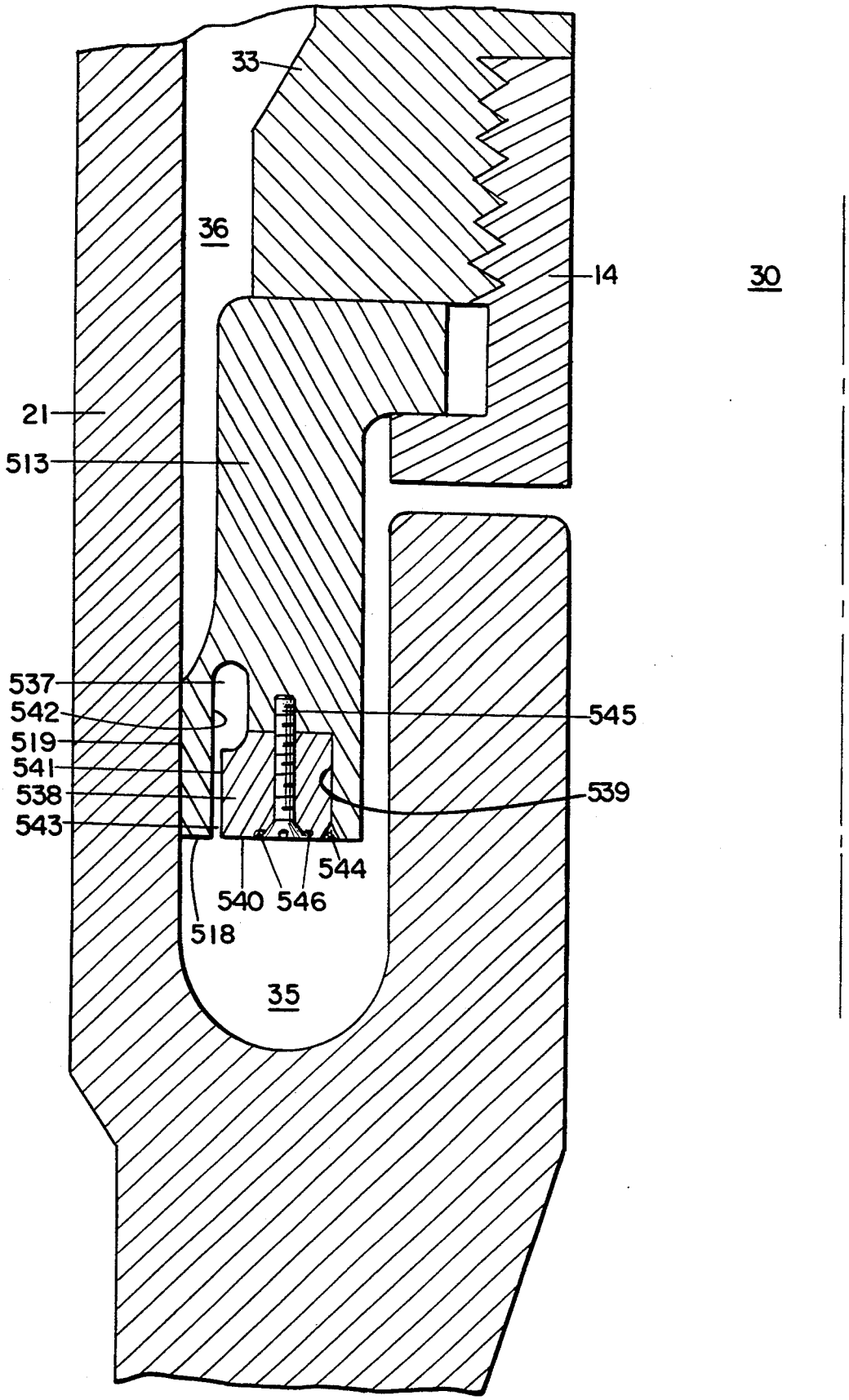
FIG. 7 is an enlarged, fragmentary cross sectional view showing the seal surfaces of a fourth alternative improved bell seal embodying the invention.

FIG. 7 is an enlarged, fragmentary, cross sectional view of the bell seal area showing a fourth alternative improvement in accordance with the invention. The parts are the same as those shown in FIG. 6 except for the addition of means for limiting the yielding of the bell to a preselected value.

A vertically-disposed slot 537 in a bell seal 513 extends inwardly into the bell seal from a lower face 518 of the bell and is disposed inwardly of and in spaced parallelism to an outer peripheral seal surface 519 of the bell.

Slot 537 allows seal surface 519 of the bell to yield when thermal growth of the bell causes it to be larger than inner shell 21. The stress caused by the worst expected yielding should not be high enough to result in creep or permanent distortion of the bell.

A substantially flat annular ring 538 is disposed in a complementary opening 539 in lower face 518 of the bell and has a horizontally-extending lower planar face 540 disposed on a plane with lower face 518 and a vertically extending peripheral outer face 541 disposed in spaced parallelism to an inwardly facing wall 542 of slot 537 to provide a gap 543 between ring face 541 and the bell. The magnitude of yielding is limited to the gap 543 to assure that the stresses caused by yielding are small enough to prevent bending or creep.

Ring 538 is secured in opening 539 by a weld 544 and by screws 545 (only one of which is shown), which extend through the ring and are threaded at their inner ends in the bell seal.

Screws 545 are further enclosed in place as by welds 546.

It should be noted that the materials of the flexing rings as well as the bell seal flexing surfaces 419 and 519 shown in FIGS. 6 and 7, respectively, must tolerate the combination of stress and temperature without exceeding the elastic limit or creeping. The forces imposed on the opposing surface of the inner shell must likewise not be so high as to cause permanent distortion or wear on that surface.

As mentioned previously, existing bell seals are especially vulnerable to rapid heating during cold starts. They are directly exposed to the hot incoming steam and get hot quicker than the portion of the inner shell which surrounds them. That portion of the inner shell not only is not directly exposed to the high velocity steam, it also has much cooler steam on the opposite side of the wall from that which faces the bell at seal surface 19. In addition, during light load steady state operation, the temperature difference of the bell and shell will be somewhat greater than when operating at full load. Since the bell seal is very strong in construction, it tends to force the opposing wall to be stretched, leading to enlargement caused by creep as well as surface damage.

Beyond the temperature effects, this area of the turbine is subjected to high frequency pressure fluctuations which tend to vibrate any components which have freedom of motion. Split piston rings, which are sometimes used to provide seal surfaces for the bell seal, have shown obvious troubles due to vibration. Even bell seals have the capability to vibrate and batter the inner shell seal surface once some clearance has been created.

The invention hereof resolves these problems. In FIGS. 3 and 3A, flexing ring 122 is a relatively thin ring that can be expanded by a growing bell seal without requiring either very large surface forces or internal ring stress. This reduces the tendency for creep and surface damage. Further, the ring is strongly secured and not vulnerable to vibration. By keeping a neat fit against the bell seal, it also tends to restrict vibration of the bell itself.

In the two-part flexing rings 222 and 322 of FIGS. 4 and 5 respectively, additional seal surfaces 223 and 323 respectively will create a friction force if vibrational motion of the bell is encountered, thus reducing the tendency for vibration.

The sealing action in FIGS. 4 and 5 is effected by the pressure force that results from high pressure at area 35 below the bell seals 213, 313, and low pressure at the area 36 above the bell seals 213, 313.

It should also be noted that the FIGS. 4 and 5 flexing rings 222 and 322 can heat and cool rapidly at similar rates to the bell without being restrained by the adjacent inner shell walls.

It is pointed out that the flexing ring second part 222B of FIG. 4 and the breech lock flexing ring second part 322B of FIG. 5 could be secured to the inner shell by machined threads rather than by the welds 225 and 325, or by a combination of threads and a weld.

The radial clearance spaces 127, 227, 327, 437 and 543 of FIGS. 3, 4, 5, 6 and 7 respectively, should be large enough to permit thermal growth of the bell for the greatest temperature difference expected between the shell wall and the bell. A 500° F. difference, for example, could require about 0.017″ of space, depending upon the size of the bell.

Other modifications not shown or discussed will be obvious to those skilled in the art.

I claim:

1. In a turbine employing a double shell construction of inner and outer shells and bell seals having a radial sealing portion, the improvement comprising flexing ring permitting deflection and differential expansion of the bell seals and shells caused by thermal gradients without causing either surface damage to the inner shell or permanent stretching of the radial sealing portion, the flexing ring being secured to the inner shell surface facing the bell, and being arranged to provide zero radial clearance with the shell at a point of fastening to the shell and very small radial clearance with the shell at a point of contact with the bell; said flexing ring also being of relatively thin thickness so as to require relatively small forces to cause sufficient stretching to match the thermal growth occurring in the bell and being fabricated from material to tolerate the stress of being stretched without creep and permanent distortion and having sufficient radial clearance with the shell to permit the aforementioned stretching while maintaining a zero clearance with the shell at the point of fastening.

2. In a turbine according to claim 1, wherein said flexing ring is of two-part construction, with the first part having a very small radial clearance with the shell and the second part having zero radial clearance with the shell.

3. In a turbine according to claim 2, wherein the flexing ring first part is vertically located on a shoulder on the inner shell surface.

4. In a turbine according to claim 2, including a breech lock mechanism interengaging the flexing ring first and second parts.

* * * * *